US011110319B1

(12) United States Patent
Boyd

(10) Patent No.: US 11,110,319 B1
(45) Date of Patent: Sep. 7, 2021

(54) PLANK EXERCISE ASSISTANCE APPARATUS

(71) Applicant: Aaron Boyd, Indianapolis, IN (US)

(72) Inventor: Aaron Boyd, Indianapolis, IN (US)

( * ) Notice: Subject to any disclaimer, the term of this patent is extended or adjusted under 35 U.S.C. 154(b) by 52 days.

(21) Appl. No.: 16/580,140

(22) Filed: Sep. 24, 2019

(51) Int. Cl.

| | |
|---|---|
| ***A63B 22/20*** | (2006.01) |
| ***A63B 21/002*** | (2006.01) |
| ***A63B 21/00*** | (2006.01) |
| ***A63B 23/12*** | (2006.01) |
| ***A63B 22/00*** | (2006.01) |

(52) U.S. Cl.
CPC ..... *A63B 22/203* (2013.01); *A63B 21/0023* (2013.01); *A63B 21/4034* (2015.10);
(Continued)

(58) Field of Classification Search
CPC ... A63B 23/047; A63B 23/0405; A63B 23/04; A63B 23/035; A63B 23/03508; A63B 23/03516; A63B 23/03575; A63B 23/03583; A63B 23/03591; A63B 23/0411; A63B 23/1227; A63B 23/1236; A63B 23/1218; A63B 23/1209; A63B 23/08; A63B 23/10; A63B 23/12; A63B 23/0494; A63B 23/0488; A63B 23/0482; A63B 23/14; A63B 23/16; A63B 23/1245; A63B 23/1254; A63B 23/1263; A63B 23/1272; A63B 23/1281; A63B 23/129; A63B 23/00; A63B 23/02; A63B 23/0205; A63B 23/0211; A63B 23/0216; A63B 23/0222; A63B 23/0227; A63B 23/0355; A63B 23/03558; A63B 2208/00; A63B 2208/02; A63B 2208/0204; A63B 2208/0209; A63B 2208/0214; A63B 2208/0223; A63B 2208/0228; A63B 2208/0233; A63B 2208/0238; A63B 2208/0242; A63B 2208/0247; A63B 2208/0252; A63B 2208/0257; A63B 2208/0261; A63B 2208/0266; A63B 2208/0271;
(Continued)

(56) References Cited

U.S. PATENT DOCUMENTS 3,627,319 A * 12/1971 Van Skyhawk ..... A63B 69/407 124/16
3,784,192 A * 1/1974 Nutter ..... A63B 22/20 482/132

(Continued)

*Primary Examiner* — Gary D Urbiel Goldner
*Assistant Examiner* — Thao N Do
(74) *Attorney, Agent, or Firm* — Sanchelima & Associates PA; Christian Sanchelima; Jesus Sanchelima

(57) ABSTRACT

A plank exercise assistance apparatus including a body having a base and slidable coaster mounted underneath the base are disclosed herein. The body includes a receptacle adapted to receive a foot of a user therein. The body further includes a heel stop extending upwards from the body to help secure the foot of the user. Additionally, the body includes a leg support adapted to provide support to the leg of a user as they are using the plank exercise assistance apparatus. The user sets their foot into the receptacle and they are then free to exercise in a manner that is effective, efficient and safe. The user is then able to slide the apparatus with their foot therein to complete variations of the plank exercise. Thereby allowing a user to exercise their abdomen, backs, shoulder, arms and legs with the various exercises they complete.

4 Claims, 3 Drawing Sheets

(52) U.S. Cl.
CPC ..... *A63B 22/20* (2013.01); *A63B 23/1236* (2013.01); *A63B 2022/0033* (2013.01); *A63B 2208/0295* (2013.01)

(58) Field of Classification Search
CPC ..... A63B 2208/0276; A63B 2208/028; A63B 2208/0285; A63B 2208/0229; A63B 2208/0295; A63B 17/00; A63B 17/02; A63B 17/04; A63B 2053/0495; A63B 2053/0491; A63B 67/14; A63B 21/28; A63B 21/00; A63B 21/40; A63B 21/4001; A63B 21/4011; A63B 21/4013; A63B 21/4015; A63B 21/4017; A63B 21/4019; A63B 21/4021; A63B 21/4003; A63B 21/4005; A63B 21/4009; A63B 21/4033; A63B 21/4034; A63B 21/4035; A63B 2022/0038; A63B 2022/0035; A63B 2022/0033; A63B 2022/0025; A63B 2022/0028; A63B 2022/003; A63B 26/00; A63B 26/003; A63B 2026/006; A63B 69/3667; A63B 2069/367; A63B 71/12; A63B 71/1216; A63B 71/1225; A63B 2071/1233; A63B 2071/1241; A63B 2071/125; A63B 2071/1258; A63B 2071/1266; A63B 2071/1275; A63B 2071/1283; A63B 22/00; A63B 22/0002; A63B 22/0007; A63B 22/0025; A63B 22/04; A63B 22/0048; A63B 2023/003; A63B 2023/006; A47C 9/00; A47C 9/002; A47C 9/005; A47C 9/007; A47C 16/02; A47C 16/00; A47C 16/025; A47C 16/04; A47C 16/005
See application file for complete search history.

(56) References Cited

U.S. PATENT DOCUMENTS 5,707,062 A * 1/1998 Perillo ..... A63B 63/08 273/354
5,830,110 A * 11/1998 Fielding ..... A63B 21/05 482/44
6,942,605 B1 * 9/2005 Sukhovitsky ..... A63B 21/0004 2/24
7,828,703 B1 * 11/2010 Boesch ..... A63B 23/12 482/112
8,702,570 B1 * 4/2014 DelPriore ..... A63B 23/0355 482/51
9,199,117 B1 * 12/2015 Nicholas ..... A63B 23/03541
9,750,974 B2 * 9/2017 Whitaker ..... A63B 21/4034
10,507,359 B1 * 12/2019 Shubin Stein ..... A63B 1/00
2006/0030463 A1 * 2/2006 Maloy ..... A63B 23/1281 482/126
2009/0298657 A1 * 12/2009 Potok ..... A63B 23/1254 482/141
2010/0261590 A1 * 10/2010 Fares ..... A63B 21/00047 482/131
2010/0317496 A1 * 12/2010 Abranchess ..... A63B 21/4035 482/141
2011/0166006 A1 * 7/2011 Howard ..... A63B 23/0205 482/141
2012/0083396 A1 * 4/2012 Aquino ..... A63B 21/075 482/131
2013/0023391 A1 * 1/2013 Nicholas ..... A63B 23/0355 482/132
2013/0123079 A1 * 5/2013 Peritz ..... A63B 23/1236 482/139
2013/0252791 A1 * 9/2013 Chang ..... A63B 23/1209 482/132
2014/0018217 A1 * 1/2014 Brown ..... A63B 23/0355 482/132
2014/0187394 A1 * 7/2014 Blahnik ..... A63B 21/00181 482/141
2014/0187395 A1 * 7/2014 Blahnik ..... A63B 21/00181 482/141
2015/0343261 A1 * 12/2015 Liptack ..... A63B 21/0004 482/80
2016/0220862 A1 * 8/2016 Johnson ..... A63B 21/00185
2018/0036588 A1 * 2/2018 Brown ..... A63B 21/0004
2018/0050232 A1 * 2/2018 Bahrami ..... A63B 21/4035
2019/0076689 A1 * 3/2019 Stein ..... A63B 23/0238
2019/0366180 A1 * 12/2019 Waffensmith ..... A63B 1/00
2020/0368576 A1 * 11/2020 McKee ..... A63B 21/068

* cited by examiner

PLANK EXERCISE ASSISTANCE APPARATUS

BACKGROUND OF THE INVENTION

1. Field of the Invention

The present invention relates to a system for a plank exercise assistance apparatus and, more particularly, to a system for a plank exercise assistance apparatus that is movable as to add a range of motion to plank exercises.

2. Description of the Related Art

Several designs for plank exercise assistance apparatuses have been designed in the past. None of them, however, include a plank exercise roller comprising a conical body with a circular base having three slidable coaster devices mounted to the underside thereof, wherein the conical body includes a receptacle in the center for receiving the foot of a user. People exercise often, but there is a major issue with exercise form that may cause a user to get injured. Other times the injury comes from a lack of equipment to facilitate proper form and technique of an exercise. It is crucial for user performing a plank exercise to execute it in an efficient and effective manner. That is so as that results in greater progress in the physical appearance of a user. As well as resulting in stronger muscles as the muscles are targeted properly. Hence there is a need for a portable apparatus that allows a user to properly, safely, efficiently and effectively target their abdominal, shoulder, back, leg and arm muscles through multiple variations of the plank exercise with the present invention. Especially while minimizing the chance of injury to the user. The slidable coasters of the present invention allow a user to perform the plank and its many variations. The user may transition from one variation to another variation of the plank effortlessly. Performing multiple variations to target the abdominal muscles results in muscle confusion which allows for the muscles to grow and progress in the best and most efficient manner. A user being able to accomplish various movements or variations of the plank exercise may also help the user to stay motivated in their workout regimen as they would not become bored as there are many variations that can be chosen from.

Applicant believes that a related reference corresponds to U.S. Pat. No. 6,942,605B1 issued to Feliks Sukhovitsky for Exercise Equipment. Which is for exercise equipment for toning and strengthening the muscles of the abdomen, back, shoulders, arms and legs. However, it differs from the present invention because the Sukhovitsky reference is comprised of multiple pieces of exercise equipment. The present invention is thereby more portable as it is just one component that makes up the exercise apparatus of the present invention. Additionally, the present invention is conical shaped and receives the foot of a user so that a user keeps their hands and arms are stationery, but their feet and legs are able to move in order for them to target their abdomen primarily.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a plank exercise assistance apparatus that receives the foot of a user to allow for a user to target their abdomen, back, shoulders, legs and arms efficiently, effectively and safely while the user does plank exercises.

It is another object of this invention to provide a plank exercise assistance apparatus that is portable.

It is still another object of the present invention to provide a plank exercise assistance apparatus that is slidable on a surface to allow for a variety of plank exercises to be done.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
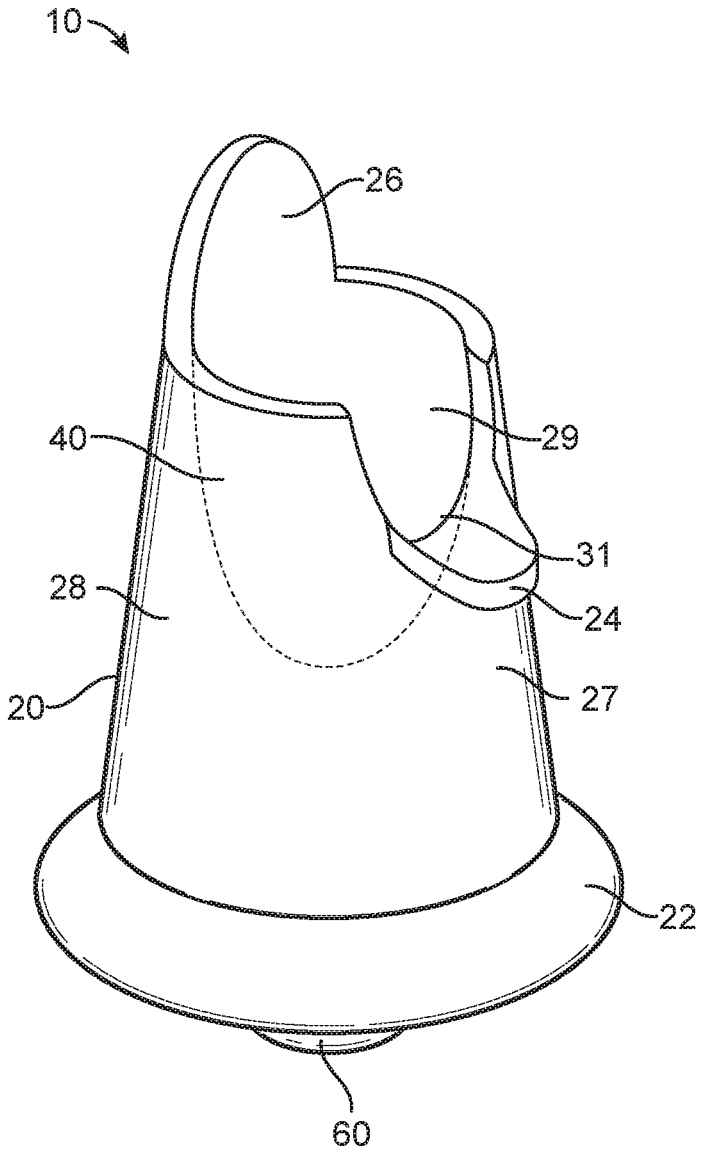
FIG. 1 represents an isometric view of the present invention.

Referring now to the drawings, where the present invention, a plank exercise assistance apparatus, is generally referred to with numeral 10, it can be observed that it basically includes a body 20, a receptacle 40, and slidable coasters 60.

Referring to FIGS. 1 through 5 it can be seen that the present invention is a plank exercise assistance apparatus 10. Plank exercise assistance apparatus 10 is meant to assist a user while they exercise. More specifically, plank exercise assistance apparatus 10 assists a user U while they execute a plank exercise movement and variations thereof. The variations of the plank are possible as the plank exercise assistance apparatus 10 can slide about a surface. The variations allow a user to target specific muscles or to work a same muscle in multiple ways. User U can choose to do a plank exercise in order to primarily target their abdominal muscles. However, the legs, shoulders, arms and back of user U are also engaged and exercised while doing the plank exercise and the many variations thereof. It is crucial that user U be efficient, effective and safe while they exercise as to avoid injuries. Additionally, it is important for user U to be efficient, effective and safe while they exercise as to allow for adequate progress to be made in the physical appearance of user U. With proper technique and a variety of exercises it is possible for user U to efficiently grow, primarily their abdominal muscles, both in appearance and strength. Plank exercise assistance apparatus 10 may be used by all age groups should they have proper education on proper exercise technique as it is so simple to use. Plank exercise assistance apparatus 10 may also help user U to express their creativity as they can achieve a plethora of variations for plank exercises and other exercises all depending on what muscles they wish to target at that moment. Plank exercise assistance apparatus 10 is simple in both construction and use that is also very durable.

Figure 3:
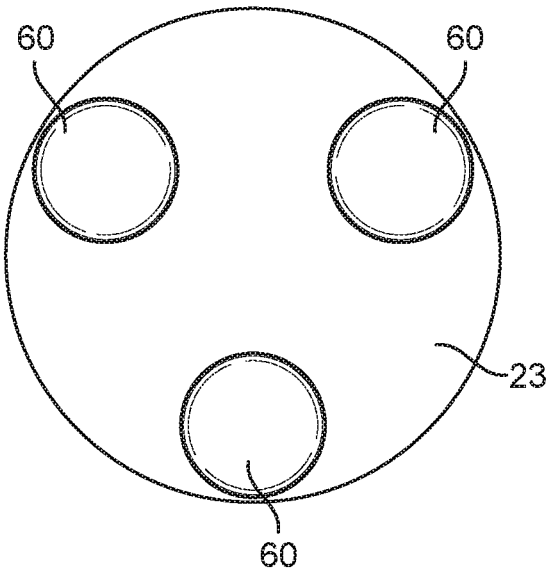
FIG. 3 shows a bottom view of the present invention which illustrates the slidable coasters of the present invention.

Referring to FIG. 1, it can be seen that an isometric view of the present invention, plank exercise assistance apparatus 10 is shown. Plank exercise assistance apparatus 10 includes body 20, receptacle 40 and slidable coasters 60. Body 20 is preferably conical shaped; however, any other shape may be suitable. The shape of the present invention does not limit the function and utility of the present invention. Body 20 may be of nearly any size and dimension. However, preferably, plank exercise assistance apparatus 10 is portable, hence plank exercise assistance apparatus 10 should not be cumbersome. Body 20 may include a front side 27 and a rear side 28. Front side 27 includes a top distal end edge 31. Front side 27 also includes a front side opening 29 extending upwardly from top distal end edge 31. Front side opening 29 may be of a size larger than a foot F of user U so as to allow foot F to pass through and be entirely housed within a receptacle 40 except for a heel H of user U. It should be understood that receptacle 40 may extend halfway down body 20. Plank exercise assistance apparatus 10 may preferably be made of plastic as to keep the present invention light weight and portable, but other materials such as rubber, metal, wood and the like may be suitable. On a lower portion of body 20 may be a base 22. Base 22 may be the widest portion of the present invention. In an alternate embodiment, base 22 may be the same size and shape as body 20. Preferably, base 22 is circular, however, base 22 may be of any other suitable shape or size. Base 22 provides support and stability to plank exercise assistance apparatus 10. Referring to FIG. 3, it can be seen that base 22 includes a bottom surface 23 underneath of base 22. On bottom surface 23 may be a plurality of slidable coasters 60 mounted thereon. In the present invention there are three slidable coasters 60 seen, but any other number of slidable coasters 60 may be suitable. Importantly, slidable coaster 60 may be of any material that is low friction when sliding on a surface. It is essential for slidable coasters 60 to be low friction as to allow user U to be able to achieve the variations of the plank exercise. The user may easily move plank exercise assistance apparatus 10 when exercising with the help of slidable coasters 60. It should be understood that the shape of slidable coasters 60 is not limited to being circular as shown. Any shape may be suitable for slidable coasters 60. Additionally, any size may be suitable for slidable coasters 60. It should be understood that the larger slidable coasters 60 are then the less amount of slidable coasters 60 are necessary to allow plank exercise assistance apparatus 10 to slide about on a surface. In an alternate embodiment slidable coasters 60 may instead be wheels or any other means that would allow plank exercise assistance apparatus 10 to slide or move about on a surface.

Figure 2:
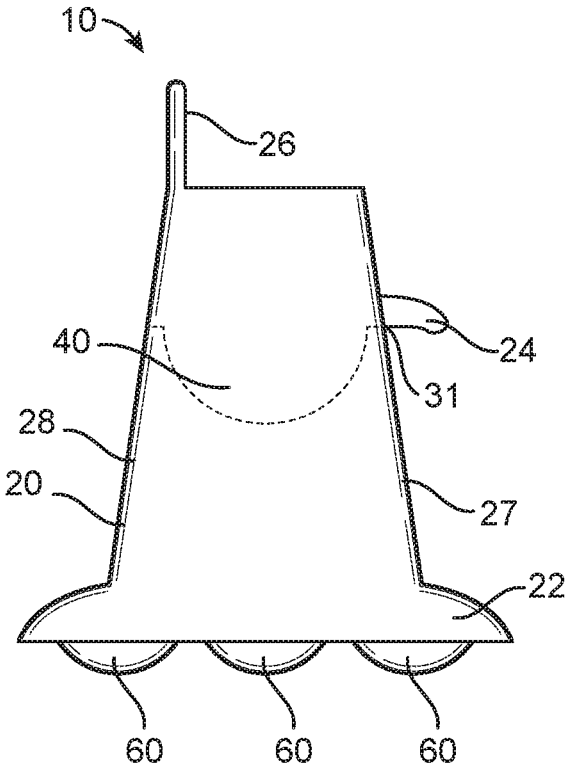
FIG. 2 shows a top view of the present invention which illustrates a foot receptacle adapted to receive the foot of a user.

Referring to FIG. 1 and FIG. 2, additional components of plank exercise assistance apparatus 10 can be seen. In FIG. 2, it can be seen that body 20 includes receptacle 40. Receptacle 40 is adapted to receive foot F of user U. User U inserts foot F with toes facing towards the bottom of receptacle 40. Receptacle 40 substantially holds foot F up until the ankle of user U. The depth of receptacle 40 may vary as per the needs of a user. The depth of receptacle 40 is not limited to being as shown, any other depths in which any portion of foot F can be received may be suitable. Preferably, user U has two of plank exercise assistance apparatus 10, one for each foot F. Thereby user U is ready to use and operate plank exercise assistance apparatus 10 once each foot F has been inserted into receptacle 40. If user U desires, user U may alternatively only exercise with one of plank exercise assistance apparatus 10. Using only one of plank exercise assistance apparatus 10 during exercise results in additional variations of the plank exercise. Further seen in FIG. 1 and FIG. 2, is a leg support 24 protruding laterally from body 20 of plank exercise assistance apparatus 10. Leg support 24 extends perpendicular to body 20 from a front side opening 29 having a top distal end edge 31. Leg support 24 helps keep a user comfortable and stable as they are operating plank exercise assistance apparatus 10. When foot F of user U is in receptable 40 leg support 24 holds the shin of user U. Thereby providing support to user U in order for injury to be minimized as user U is exercising. While user U is holding the plank position of the plank exercise, leg support 24 is able to keep user U steady in order for user U to properly target the desired muscles, which are often times with the plank exercise the abdominal muscles. Another component seen that helps user U is a heel stopper 26. Heel stopper 26 is intended to keep the heel of user U in place. User U can push their heel up against heel stopper 26 in order to obtain additional support while executing the plank exercise and its many variations. Leg support 24 and heel stopper 26 assist user U in performing the plank exercise in an efficient, effective and safe manner. Additionally, leg support 24 and heel stopper 26 also provide support to user U while user U exercises. Leg support 24 and heel stopper 26 further aid in securing user U, more specifically foot F of user U, while user U is exercising with plank exercise assistance apparatus 10. The dimension of leg support 24 and heel stopper 26 may vary as per the needs a person. That is to mean that leg support 24 may be longer or shorter as to support more or less, respectively, of the leg of user U. Heel stopper 26 may be longer or shorter as well as to better receive, accommodate and support people of different sizes, depending on the needs of those users.

Figure 4:
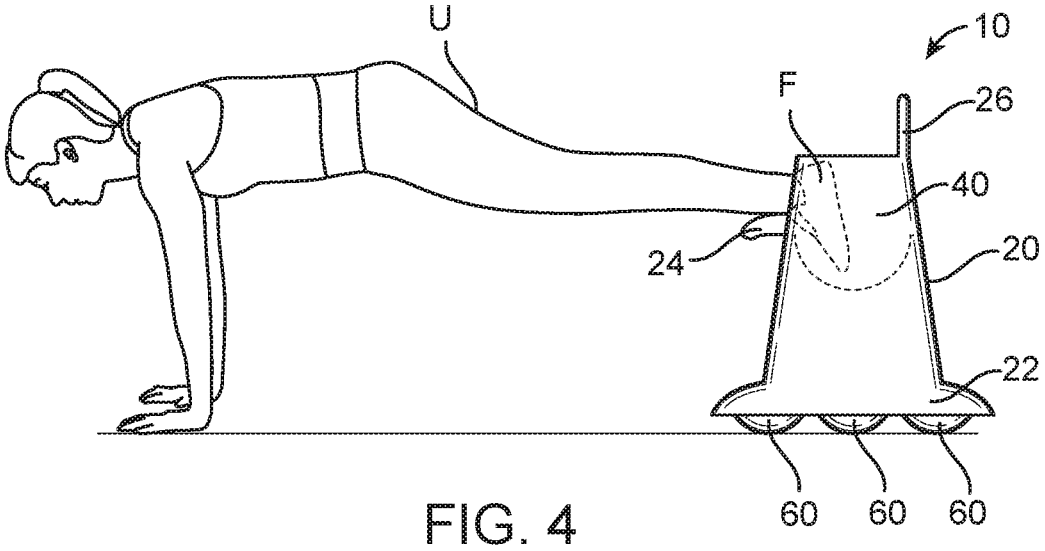
FIG. 4 illustrates a user operating the present invention to achieve a standard plank movement exercise.
Figure 5:
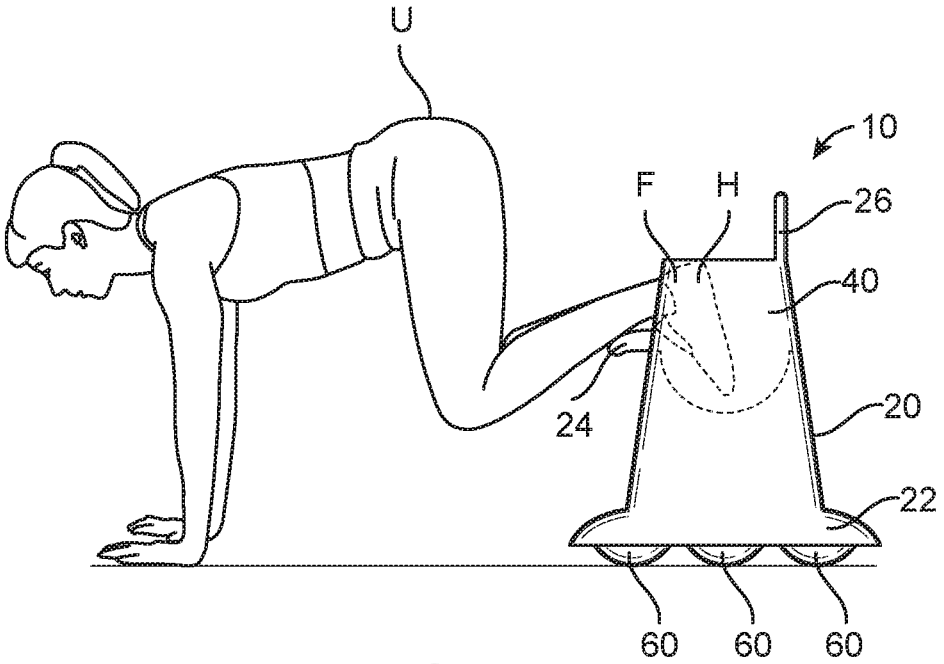
FIG. 5 illustrates a user operating the present invention to achieve a variation of the plank movement exercise.

Referring to FIG. 4 and FIG. 5 it can be seen how user U is to operate plank exercise assistance apparatus 10 in order to exercise with variations of the plank exercise. Shown, in FIG. 4, is user U with two of plank exercise assistance apparatus 10. User U may use one or two of plank exercise assistance apparatus 10. User U sets foot F into receptacle 40 to achieve a plank position. It can be seen that user U is stationary in a standard plank while using plank exercise assistance apparatus 10. User U has their entire body extended with their hands and arms being directly underneath their shoulders, their legs fully extended, and their feet are in plank exercise assistance apparatus 10. This position is a plank which primarily targets the abdominal muscles, but the legs shoulders, arms and back are also targeted with this exercise movement. User may then move their feet towards their chest for example, as shown in FIG. 5, while maintaining each foot F in separate plank exercise assistance apparatus 10. This movement is possible due to slidable coasters 60. Thereby, user U has achieved a variation of the plank exercise. User U simply changes positions from the one shown in FIG. 4 and the one shown in FIG. 5; completion of both positions results in one repetition of the exercise being completed. User U would be unable to achieve this and many other variations of the plank movement without the present invention. User U can achieve various versions of the plank exercise in a manner that is safe, effective and efficient with the present invention. Thereby, user U can improve on their physical appearance and well-being with plank exercise assistance apparatus 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a plank exercise assistance apparatus, comprising:

a. a body having a frustoconical shape including a base, said base extending circumferentially about a bottom edge of the body, said base having a bottom surface, said body having a front side and a rear side;

b. slidable coasters mounted under said bottom surface of said base, wherein the slidable coasters are hemispheres with a flat portion mounted to the bottom surface, said hemispheres being smooth to reduce friction when traveling across a surface;

c. a receptacle in a center of said body, said receptacle including a cavity that extends from an interior edge of an open top portion to an interior central U-shaped portion with respect to the body, the interior central U-shaped portion adapted to receive both feet of a user;

d. a front side opening of said front side adapted to be of a size larger than both feet of the user so as to allow said both feet of the user to pass through and be entirely housed within said receptacle with an exception of a heel of the user;

e. a heel stopper extending vertically from said rear side adapted to prevent the heel of the user passing beyond said heel stopper, wherein said heel stopper creates a convex extension of a top edge of the rear side; and f. a leg support protruding laterally from the front side, wherein the leg support is located entirely between the heel stopper and the base, the leg support extending away from said base towards said user, said leg support adapted to cradle a shin of the user, said base extending further than the leg support.

2. The system of claim 1, wherein the slidable coasters are three coasters that are equally spaced.

3. The system of claim 1, wherein said slidable coasters are wheels.

4. A system for a plank exercise assistance apparatus, consisting of:

a. a body having a frustoconical shape with an open top portion, said body including a base extending circumferentially about a bottom edge of the body, said base having a flat bottom surface, said body having a front side and a rear side;

b. a receptacle in a center of said body, said receptacle including a cavity that extends from an interior edge of the open top portion to an interior central U-shaped portion with respect to the body, the interior central U-shaped portion adapted to receive both feet of a user via a front side opening of said front side;

c. three slidable coasters mounted equally spaced under said flat bottom surface of the base, wherein the three slidable coasters are hemispheres with a flat portion mounted to the flat bottom surface, said hemispheres being smooth to reduce friction when traveling across a surface;

d. a heel stopper extending vertically from said rear side, wherein said heel stopper creates a convex extension of a top edge of the rear side; and e. a leg support protruding laterally from the front side, wherein the leg support is located entirely between the heel stopper and the base, the leg support extending away from said base towards said user, said leg support adapted to cradle a shin of the user, said base extending further than the leg support.

* * * * *